United States Patent [19]

Drumare

[11] 4,334,410

[45] Jun. 15, 1982

[54] TANK DESIGNED TO CONTAIN A LIQUEFIED GAS

[76] Inventor: Huguette Drumare, 28 rue du Commandant Vesco, Sainte Adresse, France, 76310

[21] Appl. No.: 212,426

[22] Filed: Dec. 3, 1980

[51] Int. Cl.[3] ..... F17C 13/02

[52] U.S. Cl. ..... 62/49; 62/55; 73/295; 137/392; 137/613

[58] Field of Search ..... 62/49, 55; 73/295; 137/392, 613

[56] References Cited

U.S. PATENT DOCUMENTS

| | | | |
|---|---|---|---|
| 3,170,479 | 2/1965 | Mueller | 62/49 |
| 3,262,280 | 7/1966 | Chaney | 62/49 |
| 3,938,347 | 2/1976 | Riedel et al. | 62/49 |
| 4,059,424 | 11/1977 | Bentz | 62/49 |
| 4,135,548 | 1/1979 | Sears | 62/49 |

FOREIGN PATENT DOCUMENTS

| | | |
|---|---|---|
| 1455120 | 10/1966 | France . |
| 1474849 | 3/1967 | France . |
| 2099987 | 3/1972 | France . |
| 2313707 | 12/1976 | France . |

*Primary Examiner*—Ronald C. Capossela
*Attorney, Agent, or Firm*—Brooks Haidt Haffner & Delahunty

[57] ABSTRACT

The invention relates to a tank designed to contain a liquefied gas, constituted by the tank proper, by a feedpipe, and by a valve closing off said feedpipe.

Said tank is provided with a heat-responsive device controlling the valve, whose temperature responsive element is placed inside the tank, close to a preset filling level and whose effect is to place the valve in a configuration where the feedpipe is completely closed off, when the pre-set filling level is reached, and in a configuration where the feedpipe is open, when the pre-set filling level is not reached.

The invention finds an application in methane tankers where the tanks are filled to the top.

8 Claims, 5 Drawing Figures

TANK DESIGNED TO CONTAIN A LIQUEFIED GAS

Figure 1:
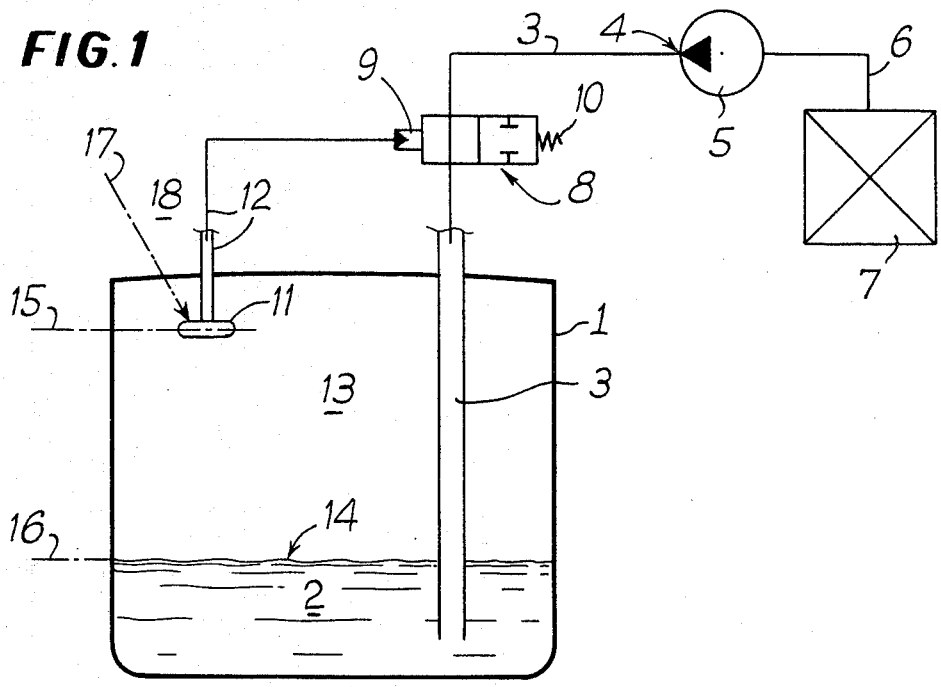

The technical field of the invention is that of safety devices relative to the design of tanks for use in methane-tankers, and more generally, tanks capable of containing liquid gases.

According to the known technique, such tanks are filled up to 98% of their volume, at the maximum, in order to avoid any possible risks of overflow and of the liquid gas spreading on the top of the tank as a result. Such spreading of a liquid at −160° C. could create a thermal shock and cause fractures due to the fact that steel becomes brittle at low temperatures.

The problem arising is therefore to prevent any overflows, and particularly when the tanks are filled.

It is therefore the object of the invention to propose a tank adapted to this effect, and which is designed to contain a liquefied gas such as, for example, a tank for a ship transporting natural gas reduced to liquid form or oil gas, which tank comprises the tank proper, a feed pipe, and at least one valve for closing off the said feed pipe.

Said tank is provided with at least one heat-responsive device controlling the said closing off valve, control device:

which is coupled to said valve, whose temperature-responsive element is placed inside the tank, close to a pre-set filling level, and has a temperature adapted to be equal, either to the temperature of the liquefied gas contained in the tank when the said gas reaches the pre-set filling level or to a temperature higher than that of the said liquefied gas when the said pre-set filling level is not reached, and whose effect on the closing off valve is to place said valve in a configuration where the feed pipe is entirely closed off, when the said pre-set filling level is reached, and, in a configuration where the said feed pipe is opened, when the said pre-set filling level is not reached.

The following arrangements are also preferably adopted:

the tank is provided with another valve, situated on the feed pipe, and with another heat-responsive device controlling the configuration of this other valve, whose responsive element is situated close to another pre-set filling level, whereas the effect of this other heat-responsive device on the said other valve is to place it in a configuration of only partial closure of the feedpipe, when said other pre-set filling level is reached and, in its opened configuration of the said feedpipe when the said other pre-set filling level is not reached, the responsive element corresponding to the closing off valve and/or to the other valve, is constituted by an enclosure, which is closed, which is connected via a conduit to a pressurized fluid member controlling the opening of the corresponding valve, whose effect is opposed to the action of a return spring, provided for returning the said valve to its closing off configuration, and which contains a specific gas, such as nitrogen, at least partly liquefiable at the temperature of the liquefied gas contained in the tank, and, in the gaseous state, at a temperature higher than that of the said liquefied gas contained in the tank, and which is its temperature when the said enclosure is placed above the surface of the liquefied gas contained in the tank;

the responsive element corresponding to the closing valve and/or to the other valve comprises a coating which is heat-insulating with respect to the gases and porous with respect to liquids, a perforated covering surrounds the coating and contributes to maintaining its integrity, the said casing is constituted by a stainless steel netting, the responsive element corresponding to the closing off valve and/or to the other valve is situated inside a perforated cage which is mechanically resistant to the maximum pressure inside the said responsive element, the said responsive element comprises a protection means against the contact of the liquefied gas resulting only from any agitation that may occur on the surface of the liquefied gas contained in the tank, the responsive element corresponding to the closing off valve and/or to the other valve is situated in a position exposed to a partial thermal leak outside the tank.

Figure 2:
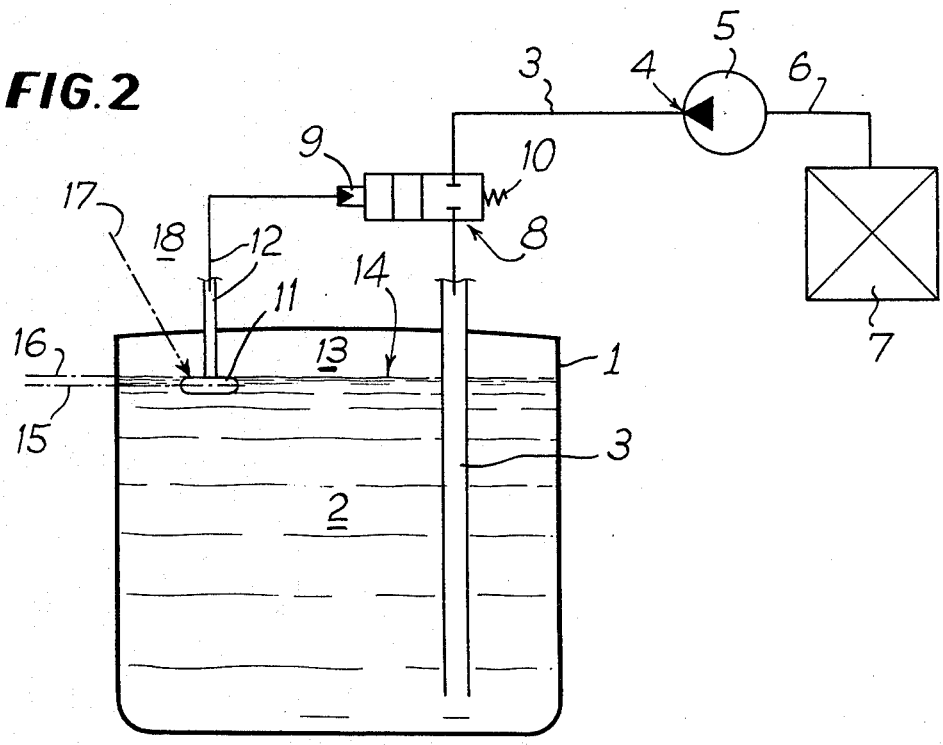
Figure 3:
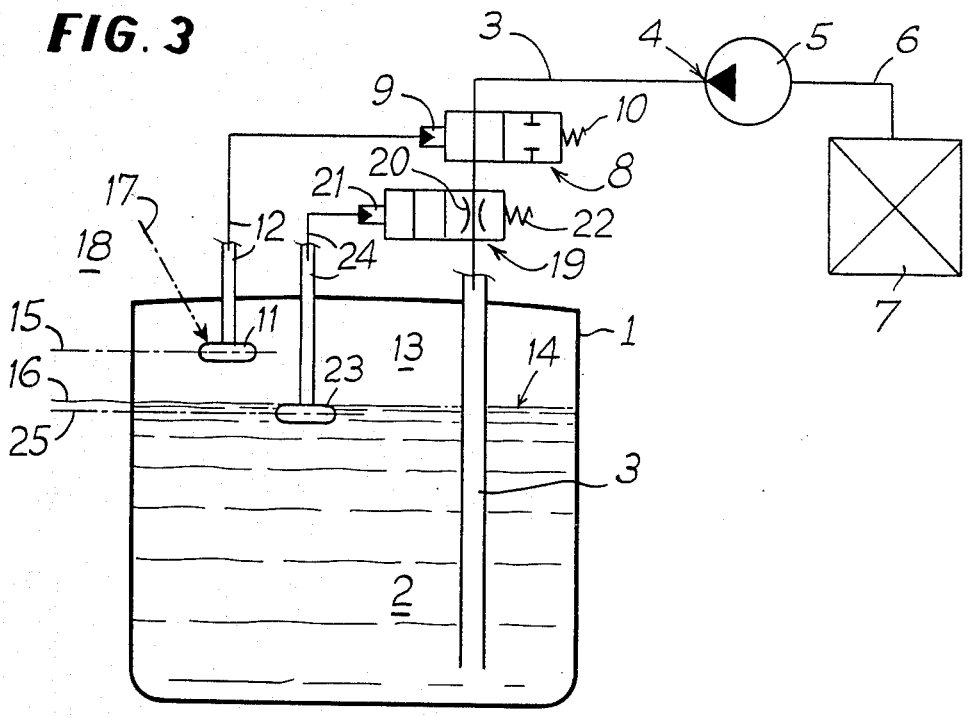
Figure 4:
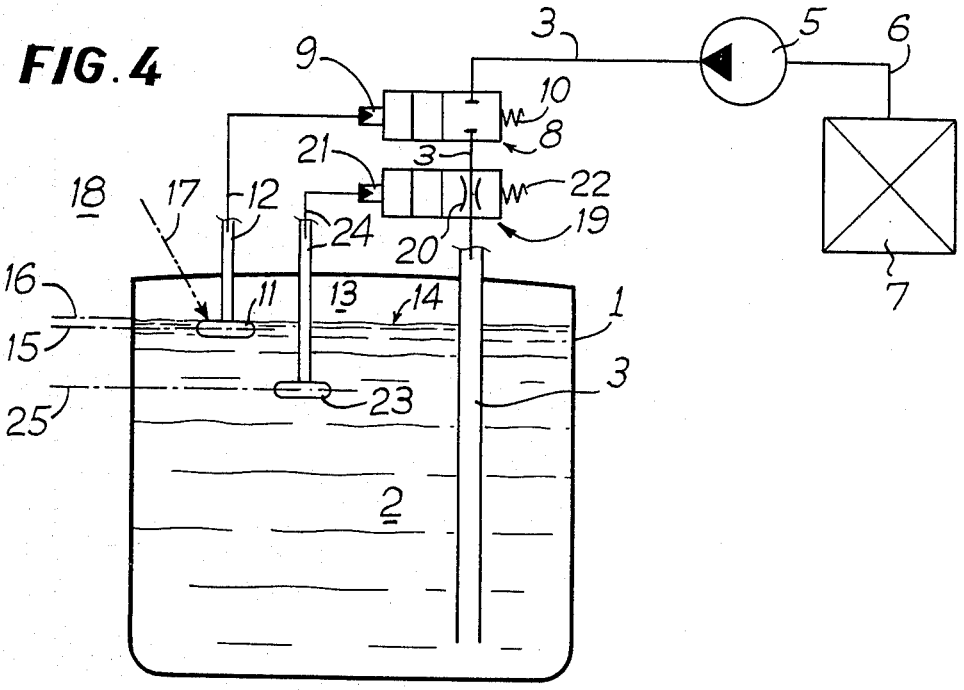
Figure 5:
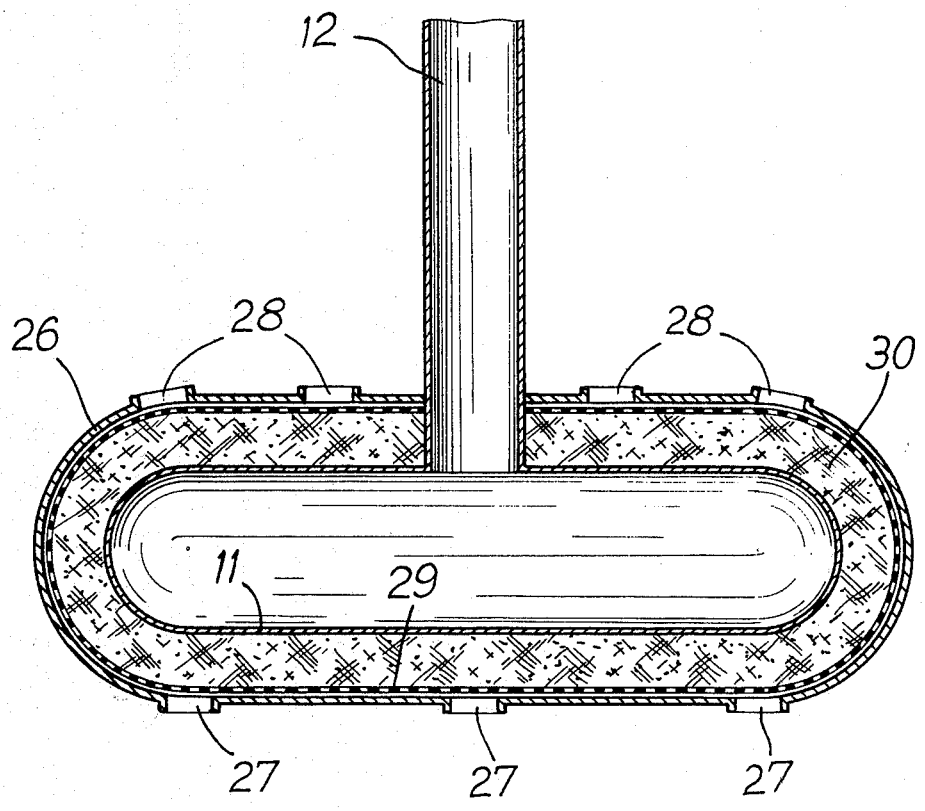

The invention will be more readily understood on reading the following description with reference to the accompanying drawings, in which:

FIGS. 1 and 2 show two separate configurations of a first embodiment of the invention, FIGS. 3 and 4 show two separate configurations of a second embodiment of the invention, and, FIG. 5 is a cross-section of the responsive element of a heat-responsive device used in the embodiments of FIGS. 1 to 4.

FIGS. 1 and 2 illustrate a tank 1 designed for a methane-tanker, which tank is filled with liquid methane 2. A feedpipe 3 connects said tank to the compression fitting 4 of a filling pump 5, which pump is connected via its suction pipe 6 to a methane tank 7. A closing valve 8 is placed on the conduit 3.

This valve 8 is capable of occupying two positions, one position in which the pipe 3 is open, as shown in FIG. 1 and the other in which the pipe 3 is closed off, as shown in FIG. 2. The said valve is coupled, on the one hand, to a jack 9 controlling the opening position and, on the other hand, to a spring 10, whose action opposes that of the jack, and therefore controls the closing off position.

Moreover, a heat-responsive device 11 is placed inside the tank 1 and is constituted by an enclosure connected to the jack 9 via a pipe 12 and containing a gas which can be reduced to the liquid state at the temperature of the liquid methane 2 and which is in gaseous state when the enclosure 11 does not lie under the surface of the liquid methane, and is placed in the volume 13 of methane in gaseous phase situated above the surface 14 of the liquid methane. Said enclosure 11 is situated in the top part of the tank 1, at a level 15, which is higher than the level 16 of the surface 14 in the configuration shown in FIG. 1, and which is, on the contrary, lower than said level 16 in the configuration of FIG. 2, wherein the quantity of liquid methane 2 contained in the tank is greater than that in the configuration shown in FIG. 1.

It is finally advantageous for the enclosure 11 to be exposed to a slight thermal leak 17, constituted for example by a pipe placing the environment outside the enclosure in communication with the outside 18 of the tank 1.

It will also be noted that the gas in the enclosure 11 can be nitrogen, which is in gaseous phase above −147° C. and which is in liquid phase under −147° C., and therefore at −160° C., the temperature of the liquid methane 2. Also, the methane in gaseous phase contained in the space 13 has a temperature higher than −147° C., at least in the zone of the thermal leak 17. It is also a well-known fact that the free volume of a predetermined mass of nitrogen is very much smaller in the liquid phase than the volume of the same mass in the gaseous phase. The nitrogen contained in the enclosure 11, the pipe 12 and the jack 9 has no free volume so that the pressure inside the said enclosure 11 and jack 9 has a much higher value when the nitrogen is in gaseous phase than the value corresponding to the liquid phase, the difference in values being such that the effect of this pressure in the jack 9, in the first case, prevails over the effect of the spring 10 and places the valve 8 in the position of opening the pipe 3 (FIG. 1), and in the second case, is on the contrary less than the effect of the spring 10, placing the valve in the position of closing off the pipe 3 (FIG. 2).

FIGS. 3 and 4 show the same arrangements as shown in FIGS. 1 and 2 but completed. For example, on the pipe 3 there is provided another valve 19 adapted to occupy two positions, one an opening position, and the other a position closing only partly the pipe 3 (FIGS. 3 and 4), in which a restriction 20 is placed on the pipe 3. Said other valve 19 is coupled on the one hand to a jack 21 controlling the partial opening, and on the other hand to a spring 22, the action of which opposes that of the jack 21, and as a result controls the position of partial opening.

Another heat-responsive element 23 is placed inside the tank 1 and is similar to the device 11, in that it comprises an enclosure 23 connected to the jack 21 via a pipe 24. The characteristics of operations are identical to those of the enclosure 11, the valve 19 being in an opening position, when the level 16 of the surface 14 of the liquid methane 2 is below the level 25 of the enclosure 23, and in that it is on the contrary placed in the position of partial closure (FIGS. 3 and 4), when the level 16 of the surface of the liquid methane 2 is higher than that (25) of the enclosure 23.

It is to be noted that the level 25 of the enclosure 23 is slightly below the level 15 of the enclosure 11, the enclosure 23 being however situated in the upper part of the tank 1.

One of the two heat-responsive devices 11 and 23, the device 11, is illustrated in FIG. 5. Said Figure shows the enclosure 11 proper and the pipe 12, said enclosure being contained inside a covering 26 provided with inlets 27 at the bottom for the penetration of the liquid methane between the covering 26 and the enclosure 11, and with outlets 28 at the top for the gaseous methane. The covering 26 is designed to offer a mechanical resistance to any possible bursting pressures in the enclosure 11, (i.e. to a pressure of the order of 85 bars). Close to the covering 26, and between the latter and the enclosure 11, there is provided a fine netting 29 which is designed to retain any pieces of any materials that could be found between the enclosure and the netting. Finally, between the said netting 29 and the said enclosure 11 there is provided a heat-insulating material 30 (such as foam, or glass wool, polyurethane foam, PCV chloride foam, etc.). The assembly constituted by the covering 26, the netting 29 and the material 30 presents a certain thermal inertia and ensures the insulation of the enclosure, which is not subjected to any splashing from the agitated surface of the liquid methane, whilst continuing to respond to the immersion in the said liquid methane.

The foregoing arrangements function as described hereinafter.

In the case illustrated in FIGS. 1 and 2, the feedpipe 3 is first open and the filling is free (FIG. 1) until the level 16 of the surface 14 of the liquid methane reaches, or exceeds the level 15 of the enclosure 11 (FIG. 2). The liquefying of the nitrogen contained in said enclosure causes the valve 8 to change position, and to close off the pipe 3 and stop the filling (FIG. 2).

The intention may be to close the pipe 3 progressively. And this is precisely what the device shown in FIGS. 3 and 4 does. Indeed, the pipe 3 is first open. Then, the level 16 of the surface 14 of the liquid methane 2 reaches, or exceeds the level 25 of the enclosure 23 without however reaching the level 15 of the enclosure 23 (FIG. 3). Only the valve 19 is controlled and partly closes the pipe 3, slowing down the filling up of the tank 1. Finally, the level 16 of the surface of the liquid methane 2 reaches or exceeds the level 15 of the enclosure 11 (FIG. 4), thus causing the closing off of the pipe 3 by the valve 8, and stopping the filling.

Moreover, the filling is controlled by the very level of the surface 14 of the liquid methane 2.

The tank contains no moving parts, the valves being situated on the outside thereof.

A manometer and a pipe fitting for filling the enclosures 11 and/or 23 will be conveniently placed on the pipes 12 and/or 24 to control and complete the filling of the enclosures with nitrogen.

In view of the embodiment of FIG. 5, the functioning of the corresponding enclosure is not responsive to any splashings of the liquid methane, but responsive only to the immersion into the liquid.

The covering 26 is a safety measure against any possible bursting of the enclosure, whereas the netting 29 permits to retain any wastes, especially from the heat-insulating material 30 and thus to avoid disturbing the normal operation of the pumps and of the valves used.

The invention of course is not limited to the foregoing description, but on the contrary covers any variants which may be made thereto without departing from its scope or from its spirit.

For example, the covering 26 can advantageously be made from a fritted alloy, without any of the orifices 27 and 28, the porosity of the fritted metal being sufficient to allow the flow of the methane until it contacts the enclosure 11. Such a covering in effect has the required mechanical resistance.

In the same way, safety devices known per se, such as manocontacts acting under the action of the variation of the pressure of the gas contained in the enclosure 11 or contacts acting when the valve 8 is in the closing off position, may be added to cause the pump 5 to stop and this without departing from the scope of the invention.

It can also be mentioned that the nature of the specific gas is obviously dependent on the nature of the liquefied gas 2 and therefore of its boiling point in the conditions of use of the tank. If this gas is natural gas reduced to liquid form around 160° C., the specific gas will be nitrogen, but if the liquefied gas 2 is ethylene at below 105° C., the specific gas can then be methane—the pressures indicated in the text of the application will then be modified without for all that departing from the scope of the present invention.

The methane tank 7 can be constituted by either another tank of the same methane ship or by a land storage tank.

What is claimed is:

1. A tank for receiving liquefied gas, a feed pipe connected to said tank for supplying said liquefied gas to the interior of said tank, a first control valve and a second control valve connected to said feed pipe for controlling the flow of said gas through said feed pipe into said tank and control means for controlling the operation of said valves and thereby controlling the level of the liquefied gas in said tank, said control means comprising:

a first temperature responsive device mounted within said tank at the filling level to which said tank is to be filled with the liquefied gas, said device having thermal leak means extending to the exterior of said tank and said device being connected to said first valve for closing said first valve, and thereby to stop the flow of gas into said tank, when the liquefied gas is at said filling level and cools said device and for causing said first valve to open, and thereby to permit the flow of gas into said tank, when the liquefied gas is below said filling level and permits the temperature of said device to rise; and a second temperature responsive device mounted within said tank at a lower level below said filling level, said second device having thermal leak means extending to the exterior of said tank and said second device being connected to said second valve for partially closing said second valve, and thereby to reduce the flow of the gas into said tank, when the liquefied gas is at said lower level and cools said second device and for causing said second valve to change to a more open condition, and thereby to increase the flow of the gas into said tank, when the liquefied gas is below said lower level and permits the temperature of said second device to rise.

2. A tank as set forth in claim 1 wherein each of said first control valve and said second control valve comprises an operating member and wherein at least one of said first temperature responsive device and said second temperature responsive device comprises an enclosure filled with a gas which is at least partly liquefied and has a reduced pressure at the temperature of the liquefied gas in the tank and which has a higher pressure at temperatures above the temperature of the liquefied gas in the tank, a pressure responsive, movable member connected to said enclosure and responsive to the pressure of the gas in said enclosure and connected to the operating member of one of the first and second control valves.

3. A tank as set forth in claim 2 wherein each of the first and second control valves comprises spring means urging the operating member thereof toward its closed position.

4. A tank as set forth in claim 2 further comprising splash protection means exteriorly of said enclosure, said splash protection means comprising liquid impervious material with nonrectilinear pathways for liquid between the exterior thereof and the exterior surface of said enclosure.

5. A tank as set forth in claim 2 or 3 wherein said enclosure has an exterior coating thereon of heat insulating material which is pervious to liquids.

6. A tank as set forth in claim 5 wherein said coating is enclosed by a foraminate covering to reinforce said coating.

7. A tank as set forth in claim 6 wherein said covering is a stainless steel mesh.

8. A tank as set forth in claim 2 wherein said enclosure is enclosed by a perforated, reinforcing cage which is mechanically adequate to withstand the pressure within said enclosure.

* * * * *